United States Patent [19]

Ridley et al.

[11] Patent Number: 4,721,091

[45] Date of Patent: Jan. 26, 1988

[54] BALL PROJECTILE MACHINE

[76] Inventors: Michael G. Ridley, 6 Velmead Road, Fleet, Aldershot, Hampshire; Peter M. Will, 10 Pirbright Road, Farnborough, Hampshire, both of United Kingdom

[21] Appl. No.: 847,643

[22] Filed: Apr. 3, 1986

[30] Foreign Application Priority Data

Apr. 10, 1985 [GB] United Kingdom ..... 8509201

[51] Int. Cl.[4] ..... F41F 7/00

[52] U.S. Cl. ..... 124/26; 124/7; 124/81; 124/16; 192/41 S

[58] Field of Search ..... 124/26, 16, 7, 39, 81, 124/50, 1; 273/26 D; 192/41 S, 41 R

[56] References Cited

U.S. PATENT DOCUMENTS

| | | | |
|---|---|---|---|
| 1,480,499 | 1/1924 | Brown | 124/39 X |
| 1,777,976 | 10/1930 | Lacoste | 124/16 |
| 1,809,708 | 6/1931 | Kahler et al. | 124/16 |
| 1,916,680 | 7/1933 | Miller | 124/39 X |
| 2,885,896 | 5/1959 | Hungerford et al. | 192/41 S X |
| 3,539,042 | 11/1970 | Sacchini | 192/41 S X |
| 3,726,371 | 4/1973 | Versoy | 192/41 S X |
| 3,837,450 | 9/1974 | Malion et al. | 192/41 S X |
| 4,220,130 | 9/1980 | Glover et al. | 124/7 |
| 4,237,851 | 12/1980 | Haller | 124/16 |
| 4,249,508 | 2/1981 | Keller et al. | 124/7 X |

FOREIGN PATENT DOCUMENTS

| | | |
|---|---|---|
| 1310661 | 3/1973 | United Kingdom . |
| 2053699 | 2/1981 | United Kingdom . |

*Primary Examiner*—Richard J. Scanlan, Jr.
*Assistant Examiner*—Anthony Knight
*Attorney, Agent, or Firm*—Allegretti, Newitt, Witcoff & McAndrews, Ltd.

[57] ABSTRACT

A ball projecting machine comprises a ball striker in the form of a bar secured to a shaft rotatably mounted by bearings in a part of a machine frame. The striker carries a pin on the same side of the shaft as the end of the striker which strikes the balls. A tension spring is connected between a fixed part of the machine frame and the pin to bias the striker. The striker shaft is arranged to be rotated by a manually operated lever so that during a cycle of rotation of the striker in the striking direction, the tension spring is stressed during a first part of the cycle and during a second part of the cycle urges the striker to rotate in the striking direction. The lever is connected to the shaft through a first one-way clutch including a coil spring and drums fixed respectively to the lever and to the shaft. The shaft is connected to the machine frame part through a further one-way clutch including a coil spring and drums fixed respectively to the frame part and to the shaft. The arrangement is such that the manual rotation of the lever rotates the striker against the tension spring until the over-center position of the spring is reached, whereafter the striker rotates rapidly in the striking direction under the influence of the stressed spring to strike and project the ball. Thereafter, the striker continues to rotate under the influence of kinetic energy and stresses the spring until the latter overcomes the kinetic energy. At this time, the striker is prevented from reverse rotation by the further one-way clutch between the shaft and the frame part rather than by the first one-way clutch between the shaft and the lever. This avoids any need for the lever to be held or rotated in the striking direction after a ball has been struck and before another is to be struck.

7 Claims, 4 Drawing Figures

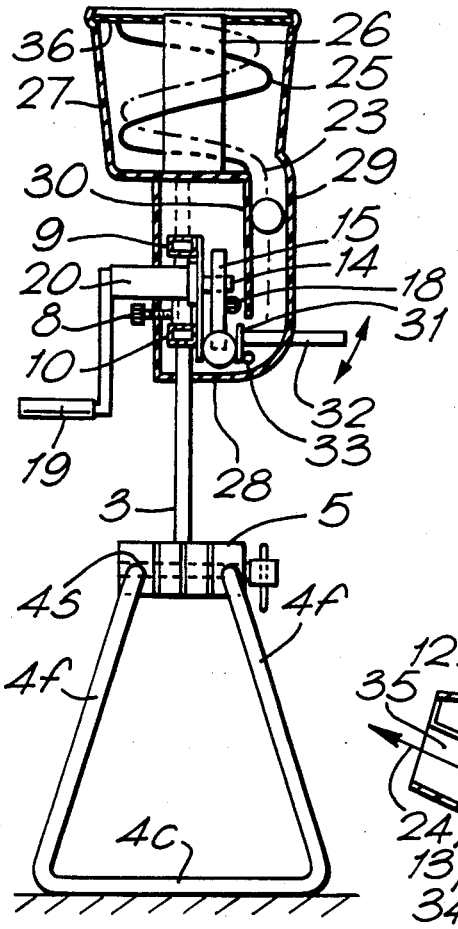
FIG.2.
FIG.1.
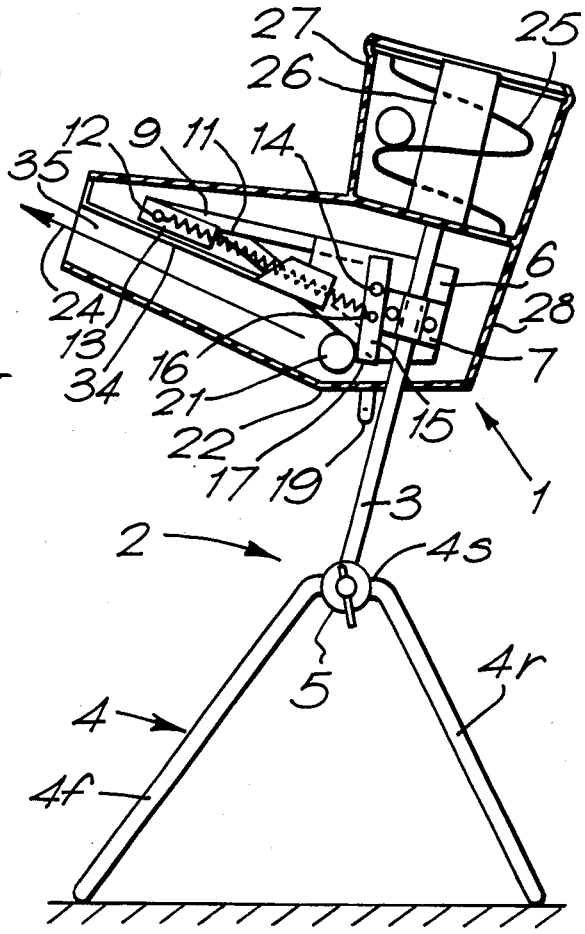

BALL PROJECTILE MACHINE

FIELD OF THE INVENTION

The present invention relates to a ball projecting machine, which is particularly, though not exclusively, suitable for projecting tennis balls for practice play with them.

BACKGROUND ART

A portable ball throwing machine is described in British Patent Specification No. 2,053,699 in the name of Rallymaster Inc., which was filed claiming priority from a U.S. application Ser. No. 59,984, filed on July 23, 1979 in the name of J. S. Haller, now U.S. Pat. No. 4,237,851. This is a battery operated machine in which balls are supplied from a helical ball track to a firing track. A ball striker is cocked by a motor against the force of an adjustable spring. When the striker is positioned over-center, the striker rapidly rotates striking the ball. A one-way clutch mechanism is included in the gear train between the motor and ball striker, so that the kinetic energy remaining after the ball is launched is utilized to begin cocking the striker for the next cycle of operation.

SUMMARY OF THE INVENTION

The envisaged use of the machine of the present invention is that one young player (or coach) should operate the machine whilst another young player hits the balls projected by the machine. In so far as there is an operator available to operate the machine, it is unnecessary that it be electrically driven.

Accordingly, the object of the present invention is to provide a manually operable ball projecting machine.

The ball projecting machine of the invention comprises a ball striker rotatably mounted in the machine about an axis extending transversely of the direction of extension of the striker; a spring connected to the striker in an over-the center manner, whereby during a cycle of rotation of the striker in a striking direction about the axis in a first part of the cycle the spring is stressed and in a further part of the cycle the spring urges the striker to strikingly rotate; a manually operable lever mounted for rotation about the axis for rotating the striker to stress the spring until an over-center position is reached whereupon the spring urges the striker to strikingly rotate; and a twin one-way clutch mechanism arranged:

(a) to release for permitting rotation of the striker in the striking direction and to engage for preventing reverse rotation of the striker under the action of the spring prior to the over-center position being reached, and (b) to engage for transferring actuation of the manually operable lever in the striking rotation direction to the striker and to release for allowing free rotation of the lever in the other direction and for preventing high speed rotation of the striker under the action of the spring after the over-center position is reached being transferred to the lever.

From another aspect, the invention provides a ball projecting machine comprising a machine frame, a ball striker rotably mounted in said machine frame about a transverse axis, a spring biasing said striker and connected thereto in such manner that, during a cycle of rotation of said striker in the striking direction about said axis, said spring is stressed during a first part of the cycle and during a second part of the cycle urges said striker to rotate in a striking direction, said spring passing over-center between the parts of the cycle, a manually rotatable member mounted for rotation about said axis and connected to drive said striker in said striking direction through a one-way clutch allowing said striker to over-run the member in said striking direction, and a further one-way clutch disposed between said striker and said machine frame preventing rotation of said striker in the opposite direction of rotation to said striking direction.

A simple twin two-way clutch may be provided, as described below with reference to FIG. 4. This utilizes two one-way roller bearings mounted on a shaft connected to the striker. One bearing is accommodated in a housing fixed to a chassis of the machine, and the other is housed in a housing to which the manual lever is secured. With the lever being operated in an oscillatory manner, the shaft is rotated by the lever bearing and held by the chassis bearing until the spring passes over-centre and drives the striker around with both bearings running free. However, this clutch suffers from the fact that one-way roller bearings are very expensive and two are required.

Accordingly the preferred embodiment utilizes coil spring clutches, which are comparatively cheap and operate to tighten their grip on a surface which they lightly grip on transfer of torque in a direction to increase their degree of twist and to loosen their grip on attempted torque transfer in the other direction. This embodiment is described with reference to FIGS. 1 to 3, and comprises a striker drum fixedly connected to the striker and having an external circular cylindrical surface coaxial with the axis of rotation of the striker; a frame drum attached to the machine frame arranged adjacent to the striker drum and also having a coaxial circular cylindrical surface; a rotatable member drum attached to the rotatable member, arranged adjacent to the striker drum on the side thereof opposite from the frame drum and also having a coaxial circular cylindrical surface; and a pair of coil springs of an internal diameter to lightly grip the external drum surfaces, which are all of substantially the same external diameter, one of the coil springs bridging the frame drum and the striker drum and the other of the coil springs bridging the rotatable member drum and the striker drum and the coil springs being of opposite hand, the arrangement being such that the chassis/striker spring allows rotation of the striker in the striking direction only and the rotatable member/striker spring allows rotation of the striker in the striking direction relative to the rotatable member, transfers drive from the rotatable member to the striker in the same direction and allows free reverse rotation of the rotatable member.

BRIEF DESCRIPTION OF THE DRAWINGS

To help understanding of the invention, a specific embodiment thereof will now be described with reference to the accompanying drawings in which:

FIG. 1 is a partially cut away side view of one embodiment of a ball projecting machine according to the invention;

FIG. 2 is a partially cut away front view of the machine of FIG. 1;

DETAILED DESCRIPTION

Figure 3:
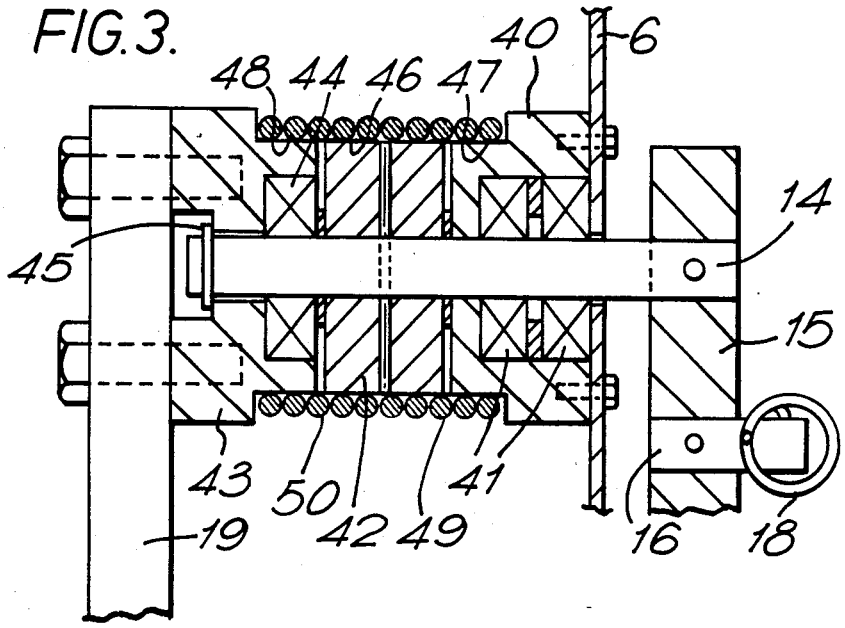
FIG. 3 is a transverse cross-sectional view of the two-way clutch mechanism of the machine of FIG. 1.

Referring first to FIGS. 1 and 2, the machine 1 has a support 2 comprised of a stem 3 angularly clamped to a leg structure 4 by a clamp 5. The leg structure includes two front legs 4*f* which are unconnected at their lower ends and two rear legs 4*r* which are interconnected at their lower ends by a connecting member 4*c*. This member 4*c*, in use resting on the ground, provides means whereby the machine may be steadied with the operator's foot. The clamp 5 acts to clamp short members 4*s* at each side, between the respective legs 4*f* and 4*r*, to the stem 3.

The machine has a sheet metal chassis 6 clamped to the stem 3 by a clamp plate 7 actuated by a screw knob 8. Upper and lower arms 9, 10 of square section steel tube are fixed to the chassis plate 6 and extend forwards. They meet and are fixed together at 11. At its forward end, the upper arm 9 carries a spring anchor pin 12 which is supported at its end remote from the arm 9 by a bracket 13. The chassis plate 6 journals a shaft 14, as will be described in more detail below. The ball striker 15 is secured to the shaft 14. The ball striker carries a pin 16 between the shaft 14 and its ball striking end 17. A spring 18 extends between the anchor 12 and the pin 16.

To the free end of the shaft 14, a handle 19 is connected via a twin one-way clutch mechanism 20 described in more detail below with reference to FIG. 3. When the handle 19 is moved in a clockwise direction in FIG. 1, the spring 18 is tensioned whilst the pin 16 is above the shaft 14. When the pin 16 moves over-center, i.e. to below the line connecting the anchor 12 and the shaft 14 when the pin 16 is to the right of the shaft 14, the spring 18 drives the striker 15 in a clockwise direction striking a ball 21 delivered to a launch position 22 via a ball feed path 23. The struck ball is projected in the direction of the arrow 24, and the striker continues to rotate until it reaches a position where its kinetic energy in rotation has been transferred to potential energy in the spring. Typically this position is reached when the striker extends substantially upright from the shaft 14.

The ball path 23 is determined, as to its upper portion, by a spiral wire 25 spacedly winding around a tubular member 26. A chute 27 is provided externally of the wire 25 as part of a plastics material moulding forming a housing 28 of the mechanism.

A lower portion of the ball path 23 is defined between a groove 29 defined in the housing 28 and a separator plate 30 provided between the groove 29 and the striker 15. The lowest ball on the ball path 23 comes to rest at the launch position 22 and the succeeding ball replaces it when the lowest ball has been projected from the machine.

An interlock 31 is provided to spring into the path of the striker 15 unless it is withdrawn by moving a handle 32 downwards about a pivot point 33.

A spring guard 34 is provided at the upper edge of a launch tube portion 35 of the housing 28.

For transport of the machine 1, the knob 8 is released and the stem 3 telescopes into the tube 26. The housing 28 can then be swung to lie between the legs 4*f* and 4*r* by releasing the clamp 5. The machine may then be carried by the leg-connecting member 4*c*. Any balls still in the ball path 23 may be retained there by a clip 36 releasably engaged in the mouth of the chute 27.

Turning now to FIG. 3, the twin one-way clutch mechanism will be described in more detail. A bearing housing 40 is bolted to the chassis plate 6 on the side opposite from the striker 15 and accommodates two ball-bearing units 41. The shaft 14 is journalled in the bearings 41 and extends through a drum 42 to a handle bearing housing 43 in which is mounted a third bearing unit 44 journalling the housing 43 on the shaft 14. The handle 19 is bolted to the housing 43. The shaft is pressed into the bearing unit 41 and pinned to the striker 15. It is pinned to the drum 42 and the housing 43 is retained on it via a circlip 45. The drum 42 has an external circular cylindrical surface 46 of the same diameter as drum surfaces 47 and 48 provided on the housings 40 and 43 respectively. Clutch springs 49 and 50, wound in the opposite direction of rectangular section spring steel, bridge the drums 46 & 47 and 46 & 48 respectively. The internal diameter of the springs 49,50 is such that they lightly grip their drums. When the handle 19 is moved in a counter-clockwise direction in FIG. 1, the spring 50 slightly unwinds and slips on the drum 42. When it is moved in the clockwise direction, the spring 50 tightens and grips the drum 42. Then the drum 42 is moving in a clockwise direction with respect to the housing 40, and the spring 49 slips on the drum 46. However when the spring 18 is under tension, tending to turn the drum back in a counter-clockwise direction, the spring 49 grips the drum 42. The springs 49,50 remain gripping the drum surfaces 47,48 respectively at all times when slippage occurs between the springs and drum 42. Alternatively the springs may grip the drum 42 at all times and slip on the drum surfaces 47,48 as required.

As will be apparent from the description above, the striker is moved in a clockwise direction via the clutch mechanism by the handle 19 until the spring 18 passes its over-center position whereupon the spring drives the striker around with the clutch mechanism slipping until the ball 21 is struck and the striker comes to rest at its position where its kinetic energy has been converted into potential energy in the spring.

A feature which can be incorporated is release of the spring 18, for storage for instance, by disengagement of the spring 49. For this the drum 42 end of the spring may be provided with a lug enabling the end of the spring 49 to be urged in the untwisting direction thereby releasing the grip of the spring on the drum 42.

A further feature which can be incorporated is adjustment of the tension of the spring 18 at its over-center position, by providing an offset cam anchorage, with an adjustment handle, in place of the plain anchorage pin 12.

Figure 4:
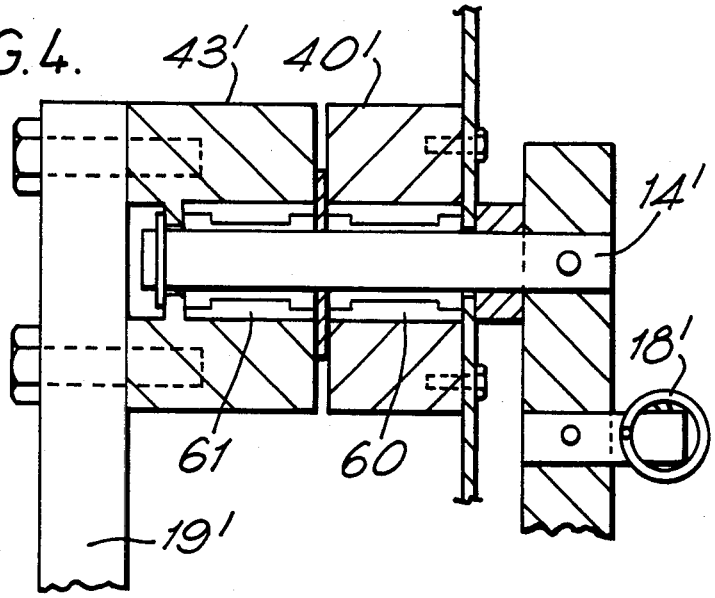
FIG. 4 is a view similar to that of FIG. 3 of an alternative two-way clutch mechanism.

FIG. 4 shows an alternative twin one-way clutch mechanism. The shaft 14′ is journalled in housings 40′,43′ by one-way roller bearings 60 and 61. The roller bearing 60 grips the shaft 14 against anti-clockwise rotation under the action of the spring 18′ and permits rotation of the shaft 14′ in the clockwise direction with respect to the housing 40′. The roller bearing unit 61 permits clockwise rotation of the shaft 14′ but grips the shaft 14′ when the handle 19′ is turned in the clockwise direction for tensioning the spring 18′.

It is envisaged that one end of each spring may be fixed to one of its drums. However in practice this is found to be unnecessary. In a non-illustrated alternative, either the striker drum or the chassis and handle drums may be dispensed with and each spring fixed via an end engaging with a respective support replacing the drum. The springs would then extend substantially entirely over the remaining drum(s) which they grip and release as in the preferred embodiment.

It is also envisaged that the drum(s) with external coil gripping surface(s) may be replaced by drum(s) with internal coil gripping surface(s) and that the coil springs should have an external diameter to lightly grip within the drums. However such an alternative is likely to be more complex.

There has thus been described and shown a ball projecting machine which comprises a ball striker in the form of a bar secured to a shaft rotatably mounted by bearings in a part of a machine frame. The striker carries a pin on the same side of the shaft as the end of the striker which strikes the balls. A tension spring is connected between a fixed part of the machine frame and the pin to bias the striker. The striker shaft is arranged to be rotated by a manually operated lever so that during a cycle of rotation of the striker in the striking direction, the tension spring is stressed during a first part of the cycle and during a second part of the cycle urges the striker to rotate in the striking direction. The lever is connected to the shaft through a first one-way clutch including a coil spring and drums fixed respectively to the lever and to the shaft. The shaft is connected to the machine frame part through a further one-way clutch including a coil spring and drums fixed respectively to the frame part and to the shaft. The arrangement is such that the manual rotation of the lever rotates the striker against the tension spring until the over-center position of the spring is reached, whereafter the striker rotates rapidly in the striking direction under the influence of the stressed spring to strike and project the ball. Thereafter, the striker continues to rotate under the influence of kinetic energy and stresses the spring until the latter overcomes the kinetic energy. At this time, the striker is prevented from reverse rotation by the further one-way clutch between the shaft and the frame part rather than by the first one-way clutch between the shaft and the lever. This avoids any need for the lever to be held or rotated in the striking direction after a ball has been struck and before another is to be struck.

Those skilled in the art will appreciate that many alternative arrangements of the invention may be embodied, all within the spirit and scope of the invention as hereinafter claimed.

We claim:

1. A ball projecting machine comprising, in combination:

a frame;

a launch tube in the frame for receiving a ball at rest at one end thereof;

a ball striker rotatably mounted on a shaft, said shaft journaled in the frame, said shaft generally transverse to the direction of projected ball travel in the launch tube, said striker extending radially from the shaft a distance sufficient to extend into striking contact with a ball at the one end of the launch tube for projecting the ball from the tube a said striker is rotated through an arc by unidirectional rotation;

a first one way clutch mechanism for attaching a manual handle means to the shaft;

a second one way clutch mechanisms for attaching the shaft to the housing to limit the direction of driven rotation of the striker by the handle means in said unidirectional sense;

a tension spring attached between the striker and the frame in position to be stressed when the striker is rotated in said unidirectional sense by the shaft to stretch the spring, said spring acting on the striker to rotate the striker in the unidirectional sense into contact with the ball in the tube when the spring is strained to its maximum.

2. A machine as claimed in claim 1, in which said one-way clutch mechanisms are coil spring clutches.

3. A machine as claimed in claim 2, comprising a striker drum fixedly connected to said striker and having an external circular cylindrical surface coaxial with the axis of rotation of said striker, a frame drum attached to said machine frame arranged adjacent to said striker drum and also having a coaxial circular cylindrical surface; a rotatable member drum attached to said manual handle means, arranged adjacent to said striker drum on the side thereof opposite from said frame drum and also having a coaxial circular cylindrical surface; and a pair of coil springs of an internal diameter to lightly grip said external drum surfaces, which are all of substantially the same external diameter; one of said coil springs bridging said frame drum and said striker drum, and the other of said coil springs bridging said rotatable member drum and said striker drum, said coil springs being of opposite hand, the one spring allowing rotation of said striker in said striking direction only and the other spring allowing rotation of said striker in said unidirectional striking direction relative to the handle means as well as transfering drive from the said handle means to said striker in the same said unidirection and allowing free reverse rotation of said handle means.

4. A machine as claimed in claim 1, in which said one-way clutch mechanisms are one-way roller bearings.

5. The machine of claim 1 including a ball feed mechanism supported on the frame for feeding a ball into the launch tube.

6. The machine of claim 1 including a support stand for the frame.

7. The machine of claim 1 wherein the shaft defines a rotation axis and wherein the spring is attached to the striker a fixed distance from the rotation axis.

* * * * *